United States Patent [19]

Hord et al.

[11] Patent Number: 4,488,365

[45] Date of Patent: Dec. 18, 1984

[54] HYDRAULIC SYSTEM FOR LAUNDRY FLATWORK IRONER

[75] Inventors: Charles F. Hord; William W. Allen, both of Plantation, Fla.

[73] Assignee: Jensen Corporation, Fort Lauderdale, Fla.

[21] Appl. No.: 446,982

[22] Filed: Dec. 6, 1982

[51] Int. Cl.[3] ..... D06F 65/06

[52] U.S. Cl. ..... 38/47; 38/52; 60/452; 91/461; 100/170

[58] Field of Search ..... 38/55, 44, 45, 46, 47, 38/48, 49, 50, 51, 52, 53, 54, 59, 61; 100/170, 17 100/172, 269 R, 46, 210; 91/461, 457, 454; 60/452. 60/443

[56] References Cited

U.S. PATENT DOCUMENTS

| | | | |
|---|---|---|---|
| 2,306,138 | 12/1942 | Pfeffer | 38/46 |
| 2,400,233 | 5/1946 | Hicks | 38/40 |
| 2,764,870 | 10/1956 | Slomer | 60/97 |
| 3,484,966 | 12/1969 | Gruner et al. | 38/55 |
| 3,584,539 | 6/1971 | Sugden, Jr. | 91/454 |
| 3,800,669 | 4/1974 | Distler | 91/411 |
| 3,878,627 | 4/1975 | Mazzolla | 38/56 |
| 3,954,046 | 5/1976 | Stillhard | 91/457 X |
| 3,995,425 | 12/1976 | Wittren | 60/452 X |
| 4,212,504 | 7/1980 | Krylov et al. | 100/170 X |
| 4,362,018 | 12/1982 | Torii | 91/457 |
| 4,373,869 | 2/1983 | Martin et al. | 60/452 X |
| 4,420,935 | 12/1983 | Kobald | 60/452 X |

*Primary Examiner*—Henry S. Jaudon
*Assistant Examiner*—Andrew M. Falik
*Attorney, Agent, or Firm*—Oltman and Flynn

[57] ABSTRACT

For operating the rollers and the steam chest in a laundry flatwork ironer a hydraulic system is provided which includes a hydraulic motor for driving the rollers, hydraulic cylinder-and-piston units for raising the steam chest, and a pump for operating the motor and the cylinder-and-piston units. Valves between the pump and the motor are selectively operable to establish low pressure standby operation of the pump with the hydraulic motor off, or low speed operation of the motor to jog the rollers or higher speed operation of the motor to drive the rollers at a speed appropriate for laundry flatwork. Other valves between the pump and the cylinder-and-piston units are selectively operable to raise the steam chest, reduce the cylinder pressure after the steam chest has been raised, and to increase the cylinder pressure whenever laundry flatwork is in the ironer.

10 Claims, 4 Drawing Figures

HYDRAULIC SYSTEM FOR LAUNDRY FLATWORK IRONER

SUMMARY OF THE INVENTION

This invention relates to a hydraulic system for driving the rollers and raising the steam chest in a flatwork steam ironer.

Various steam ironers are in use in which laundry flatwork, such as sheets and towels, passes between successive horizontal padded rollers and a steam chest presenting an upwardly-facing concave recess in close proximity below each roller. Such ironers use an electric motor drive to rotate the rollers and to raise the steam chest into operative relationship with respect to the rollers.

The present invention relates to a novel hydraulic system in which the rollers are driven by a hydraulic motor and the steam chest is raised and lowered by hydraulic cylinder-and-piston units.

A principal object of this invention is to provide a novel hydraulic system for a laundry flatwork ironer.

In a presently-preferred embodiment, the present system has a hydraulic motor for driving the rollers and an electric motor-driven pump for supplying pressurized oil to the hydraulic motor to drive it. Several valves are operatively connected to the hydraulic motor and the pump to control the torque and direction of the motor in different phases of the ironer's operation. The same pump delivers pressurized oil to cylinder-and-piston units which raise and lower the steam chest in the ironer. Several valves are operatively connected to these cylinder-and-piston units to control the upward pressure applied to the steam chest in different phases of the ironer's operation.

Further objects and advantages of this invention will be apparent from the following detailed description of a presently-preferred embodiment shown schematically in the accompanying drawings.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

FIG. 1

Figure 1:
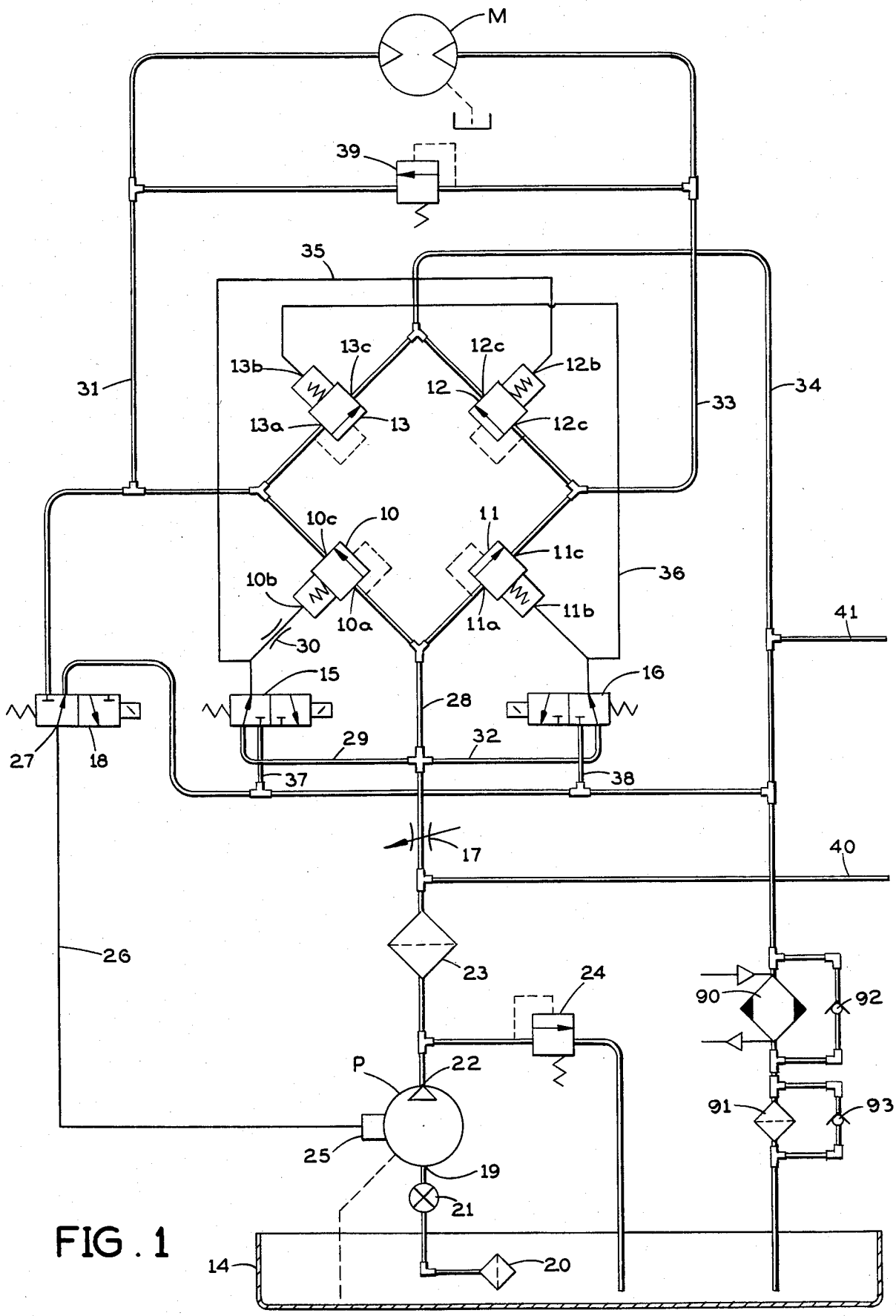
FIG. 1 is a schematic hydraulic circuit diagram showing the part of the present system which controls the operation of the hydraulic motor for driving the rollers in flatwork ironer.

FIG. 1 shows the part of the present system which controls the drive to rollers (not shown) in an ironer for ironing sheets or other laundry articles. The drive motor for these rollers is a hydraulic motor M which is driven by pressurized oil pumped by a pump P. The pump outlet is connected to one side or the other of the hydraulic motor M through motor supply valves 10 and 11, and the opposite side of the hydraulic motor is connected through motor return valve 12 or motor return valve 13 to a supply tank 14 from which the pump draws oil. Motor supply valve 10 and motor return valve 12 are opened in response to a directional control valve 15 to cause the hydraulic motor M to operate in a "forward" direction. Motor supply valve 11 and motor return valve 13 are opened in response to a second directional control valve 16 to cause the hydraulic motor to operate in the "reverse" direction. An adjustable needle valve 17 controls the speed of the hydraulic motor M. The output pressure of pump P is dependent upon a pump pressure control valve 18.

Valves 15, 16 and 18 are solenoid valves, each having its solenoid in an electrical control circuit (not shown). This control circuit contains several manually operated switches, including: (1) a start switch for turning on the electric motor which drives pump P, (2) a "forward jog" switch for operating valve 15, (3) a "forward" switch for operating both valve 15 and valve 18, (4) a "reverse job" switch for operating valve 16, and (5) a "reverse" switch for operating both valve 16 and valve 18.

The pump P has an inlet port 19 connected to receive oil from tank 14 through a filter 20 and a manually operable gate valve 21. The pump preferably is an axial piston pump driven by an electric motor (not shown) through a flexible coupling. The pump is of the variable volume, pressure/flow-compensating type and it has a high pressure compensator which limits the maximum pressure of the system to 3000 psi. The output port 22 of the pump is connected through a filter 23 to the inlet of the adjustable needle valve 17. A pressure relief valve 24 is connected between the pump outlet port 22 and the oil supply tank 14. Pump P also has a sensing port 25 which is connected through a fluid passageway 26 to one port of valve 18.

The outlet port of needle valve 17 is connected through a fluid passageway 28 to the inlet port 10*a* of valve 10 and to the inlet port 11*a* of valve 11.

Valve 10 has a pressure sensing port 10*b* which is connected to the outlet of needle valve 17 through a fluid passageway 29, valve 15, and a flow restriction 30. Valve 10 has an outlet port 10*c* which is connected through a fluid passageway 31 to the left side of hydraulic motor M in FIG. 1. Valve 10 has a spring which keeps it closed (blocking flow between its inlet and outlet ports 10*a* and 10*c*) when the fluid pressure at its sensing port 10*b* is substantially equal to or greater than the fluid pressure at its inlet port 10*a*.

Valve 11 has a pressure sensing port 11*b* which is connected to the outlet of needle valve 17 through a fluid passageway 32 and valve 16. Valve 11 has an outlet port 11*c* which is connected through a fluid passageway 33 to the right side of hydraulic motor M in FIG. 1. Valve 11 has a spring which keeps it closed (blocking flow between its inlet and outlet ports 11*a* and 11*c*) when the fluid pressure at its sensing port 11*b* is substantially equal to or greater than the fluid pressure at its inlet port 11*a*.

Valve 12 is essentially identical to valves 10 and 11. It has an inlet port 12*a* connected to fluid passageway 33, an outlet port 12*c* connected to a return passageway 34 leading back to the oil supply tank 14, and a pressure sensing port 12b connected to valve 15 through a fluid passageway 35. Valve 12 is springclosed when the fluid pressure at its sensing port 12b is substantially equal to or greater than the fluid pressure at its inlet port 12a.

Valve 13 is essentially identical to valve 12. Its inlet port 13a is connected to fluid passageway 31, its outlet port 13c is connected to fluid passageway 34, and its pressure-sensing port 13b is connected to valve 16 through a fluid passageway 36. Valve 13 is spring closed when the pressure at its sensing port 13b substantially equals or exceeds the pressure at its inlet port 13a.

When valve 15 is in the position shown schematically in FIG. 1 it applies fluid pressure from the pump output to the sensing ports 10b and 12b of valves 10 and 12, keeping them closed. Valve 15 may be actuated to a position in which it connects these sensing ports 10b and 12b to a fluid passageway 37 leading to the return passageway 34 going back to the oil supply tank. In this position of valve 15, the fluid pressure differential between ports 10a and 10b of valve 10 and between ports 12a and 12b of valve 12 is enough to cause both of these valves to open.

Similarly, when valve 16 is in the position shown schematically in FIG. 1 it applies fluid pressure from the pump output to the sensing ports 11b and 13b of valves 11 and 13, keeping these valves closed. Valve 16 may be actuated to a position in which it connects the sensing ports 11b and 13b of valves 11 and 13 to a fluid passageway 38 leading to the oil return passageway 34. In this position of valve 16, the fluid pressure differential between ports 11a and 11b of valve 11 and between ports 13a and 13b of valve 13 is enough to cause both of these valves to open.

A relief valve 39 is connected across the hydraulic motor M to protect it from high pressure surges which might occur.

Connected in series in the oil return line 34 are a heat exchanger 90 and a filter 91, each of which has a corresponding check valve 92 or 93 connected across it.

When valve 18 is in the position shown schematically in FIG. 1, through passageway 26 it connects the pressure sensing port 25 of pump P to the low pressure oil return line 34. The pump operates automatically to maintain a predetermined pressure differential, such as 200 psi, between its outlet port 22 and its sensing port 25. Therefore, in this position of valve 18 the pump output pressure will be only about 200 psi. This is the "low pressure standby" mode of the system.

Valve 18 may be actuated to a second position in which it connects the sensing port 25 of pump P to fluid passageway 31. When this happens, the pump increases its output pressure enough to maintain the predetermined pressure differential between its output port 22 and its sensing port 25.

OPERATION OF HYDRAULIC MOTOR

Before starting the electric motor for pump P, valves 15, 16 and 18 will be in the position shown schematically in FIG. 1. After the pump motor is turned on by closing the "start" switch, the pressure at the sensing port 25 of pump P will remain substantially zero and therefore the pump will produce only enough output pressure to provide the predetermined pressure differential (e.g., 200 psi) between its output port 22 and its sensing port 25. Valves 10, 11, 12 and 13 remain closed, so that the hydraulic motor M is stopped. This is the "low pressure standby" mode.

With valve 18 still in the same position, if now the "forward jog" switch is closed it will cause valve 15 to be operated to a position disconnecting the sensing ports 10b and 12b of valves 10 and 12 from the pump output and connecting these ports to the oil return passageway 34, valves 10 and 12 will open and the hydraulic motor M will operate in the forward direction at low speed. This is the "forward jog" mode in which motor M has enough torque to drive the ironer rollers slowly. This is done when the operator is placing padding on the ironer rollers.

If desired, the "reverse job" mode may be established by closing the "reverse jog" switch, which operates valve 16 to the position in which it disconnects the sensing ports 11b and 13b of valves 11 and 13 from the pump output and connects these ports to oil return passageway 34, thereby causing valves 11 and 13 to open. This would cause hydraulic motor M to operate at low speed in the reverse direction.

Forward operation of the hydraulic motor M at a normal preselected speed is established by closing the "forward" switch, which operates valves 18 and 15 from the positions shown schematically in FIG. 1 to positions in which:

(a) valve 18 connects the sensing port 25 of pump P to fluid passageway 31, (b) valve 15 connects the sensing ports 10b and 12b of valves 10 and 12 to the oil return line 34.

The pump now will produce whatever flow is required to create and maintain the preselected pressure differential between its outlet port 22 and its sensing port 25. The roller speed may be adjusted between zero and 220 feet per minute by adjusting the needle valve 17. Pressure ramps of known design may be provided in passageway 26 to control acceleration and deceleration times of the motor. During high speed deceleration, relief valve 39 can open to bypass any pressure spikes from the hydraulic motor.

Reverse operation of hydraulic motor M may be established by closing the "reverse" switch, which operates valve 16 to a position connecting the sensing ports 11b and 13b of valves 11 and 13 to the oil return line 34 and also operates valve 18 to the position connecting the sensing port 25 of pump P to fluid passageway 31.

FIG. 2

Figure 2:
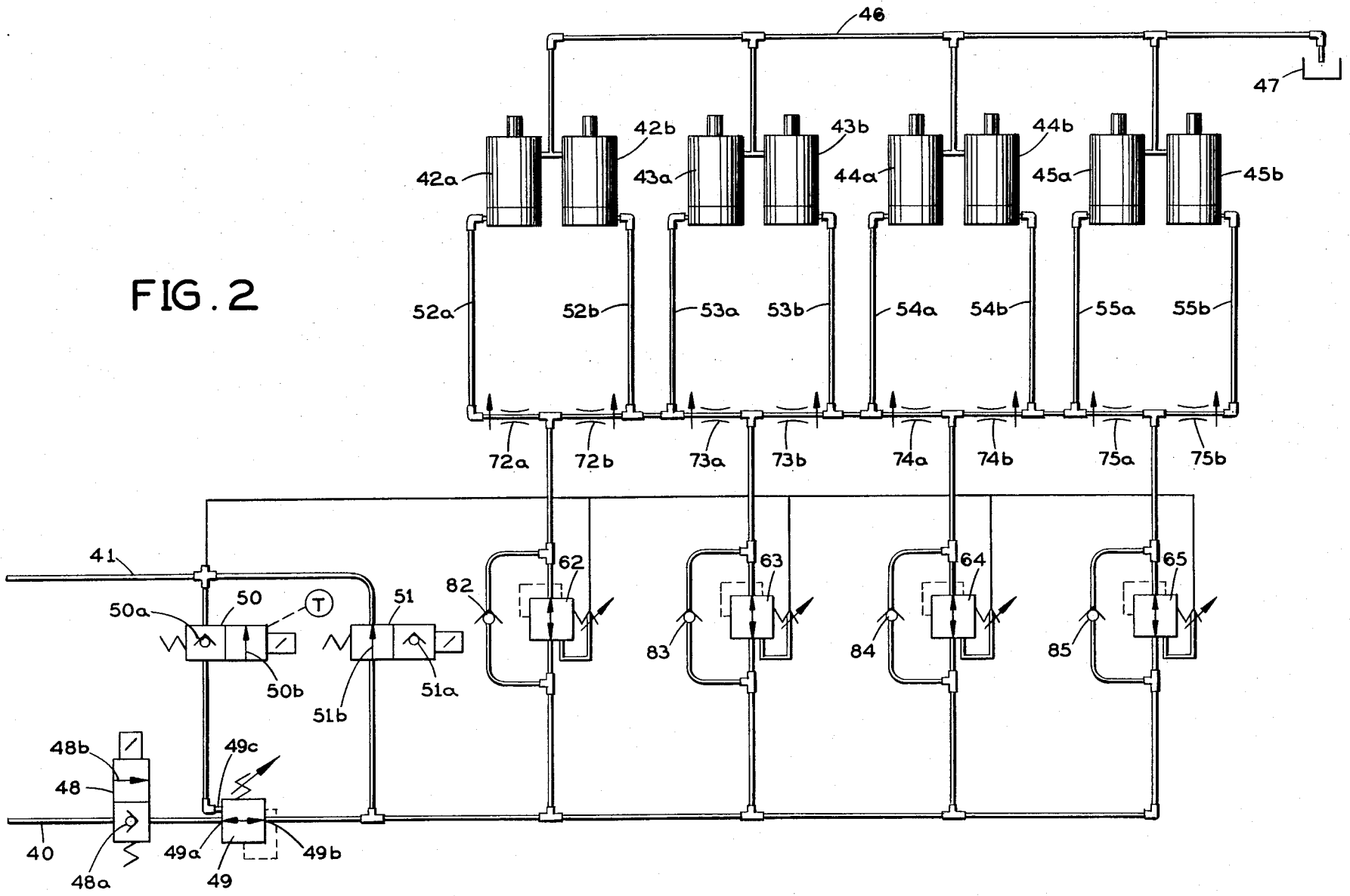
FIG. 2 is a similar view showing the remainder of the system, which controls the raising and lowering of the steam chest in the ironer.

The steam chests of the ironer are under the control of the part of the hydraulic system is shown in FIG. 2, which has a first oil passageway 40 connected to the output of pump P in FIG. 1 after the latter's outlet filter 23. The FIG. 2 apparatus has a second oil passageway 41 which, as shown in FIG. 1, is connected to the return line 34 going back to the oil supply tank 14.

The hydraulic apparatus of FIG. 2 has four pairs of cylinder-and-piston units 42a and 42b, 43a and 43b, 44a and 44b, and 45a and 45b for raising the steam chest in the ironer up toward the ironer rollers. The cylinders have respective oil supply passageways 52a and 52b, 53a and 53b, 54a and 54b, and 55a and 55b for passing pressurized oil into the lower end of each cylinder to raise the corresponding piston. The upper end of each cylinder is connected to a return line 46 leading to a sump 47.

Figure 3:
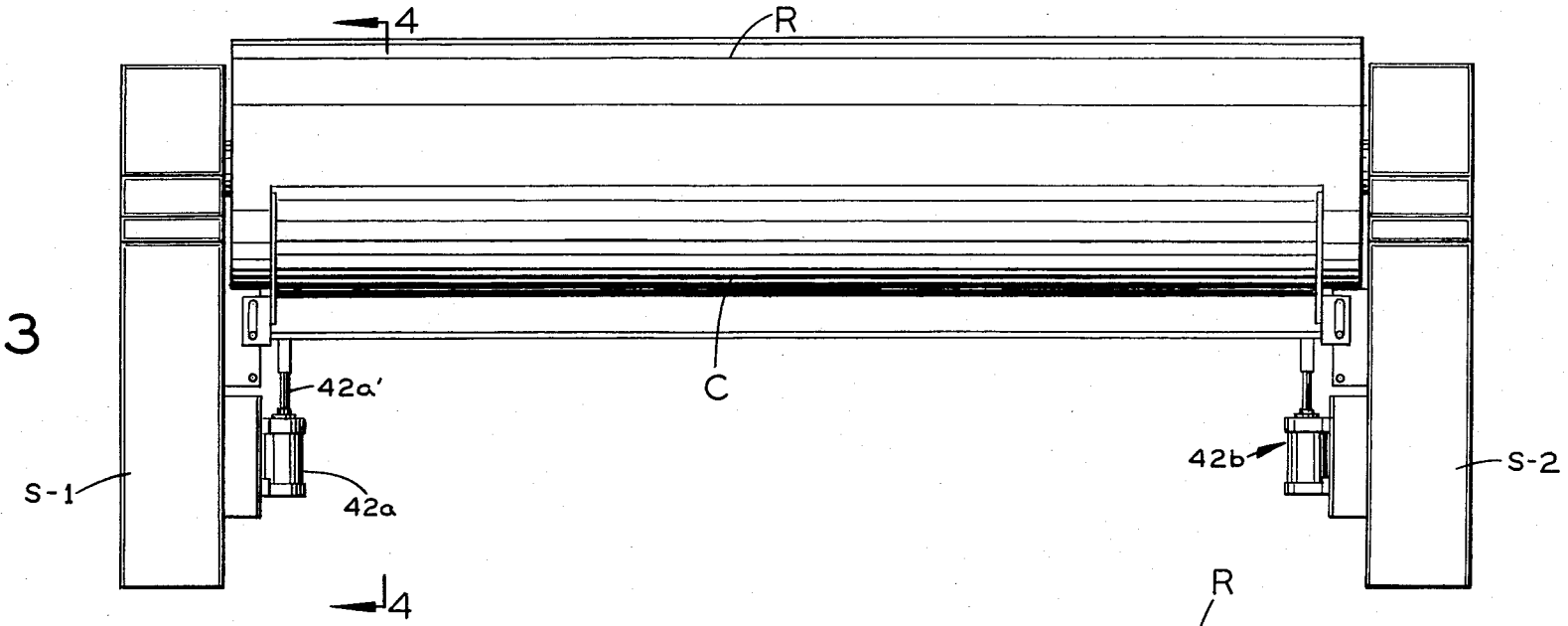
FIG. 3 is a front elevation of a vertically reciprocable steam chest below a padded roller in a known type of steam ironer on which the present hydraulic system may be used.
Figure 4:
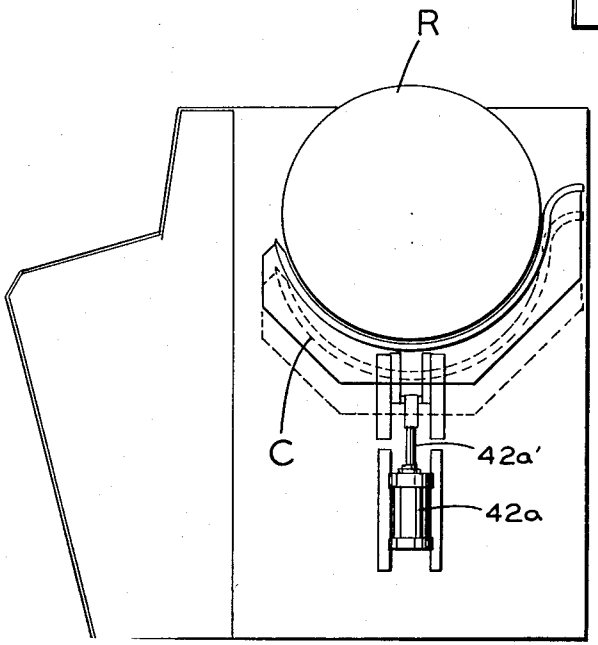
FIG. 4 is a vertical section taken along the line 4—4 on FIG. 3.

Referring to FIGS. 3 and 4, the hydraulic cylinder-and-piston units 42a and 42b are shown below the opposite ends of a steam chest C of known design, which has a respective concave top recess at each of several padded rollers in a steam ironer of known design. One of these rollers is shown at R in these Figures, extending horizontally between the opposite vertical sides S-1 and S-2 of the ironer (FIG. 3). As shown in FIG. 4, the steam chest C is vertically movable between a downwardly retracted phantom-line position and a raised full-line position next to the roller R. The upper end of the piston rod 42*a'* of cylinder-and-piston unit 42*a* is mechanically coupled to the bottom of steam chest C in any suitable manner for raising and lowering the steam chest in unison with the vertical movement of the piston in cylinder-and-piston unit 42*a*. An identical arrangement is provided at the opposite end of steam chest C for coupling it to the other cylinder-and-piston unit 42*b*.

Each of the other pairs of hydraulic cylinder-and-piston units in FIG. 2 (43*a* and 43*b*, 44*a* and 44*b*, and 45*a* and 45*b*) is coupled in the same manner to the same steam chest C below a respective padded roller in the ironer.

A pressure reducing valve 62 is connected to the oil supply passageways 52*a* and 52*b* through respective flow restrictions 72*a* and 72*b*. A check valve 82 is connected across valve 62. Similarly, a pressure reducing valve 63 and a corresponding check valve 83 are connected to the oil supply passageways 53*a* and 53*b* through flow restrictions 73*a* and 73*b*, a pressure reducing valve 64 and a corresponding check valve 84 are connected to the oil supply passageways 54*a* and 54*b* through flow restrictions 74*a* and 74*b*, and a pressure reducing valve 65 and a corresponding check valve 85 are connected to the oil supply passageways 55*a* and 55*b* through flow restrictions 75*a* and 75*b*.

The supply of pressurized oil to valves 62, 63, 64 and 65 from oil passageway 40 is under the control of valve 48 and a pressure reducing valve 49. Normally, valve 48 presents a check valve 48*a* which blocks oil from flowing from passageway 40 to the inlet of pressure reducing valve 49. Valve 48 may be operated to a second position in which it permits flow from passageway 40 to valve 49, as indicated by the arrow 48*b*.

Pressure reducing valve 49, which is of known construction and mode of operation, has an inlet port 49*a* connected to the outlet of valve 48, an outlet port 49*b* connected to valves 62, 63, 64 and 65 in parallel, and a bypass port 49*c* for connecting its inlet and outlet ports to the inlet of a valve 50 whose outlet is connected to the oil return passageway 41. Normally, valve 50 presents a check valve 50*a* between its inlet and its outlet which blocks any flow of oil through the bypass port 49*c* of valve 49 to passageway 41. Valve 50 may be operated to a second position in which it permits flow from its inlet to its outlet, as indicated by the arrow 50*b*, thereby reducing the oil pressure at the outlet port 49*b* of valve 49. This happens under the control of a timer T, as explained hereinafter.

A bypass valve 51 is connected between the outlet port 49*b* of pressure reducing valve 49 and the oil return passageway 41. Normally, valve 51 permits flow from its inlet to its outlet, as indicated by the arrow 51*b*. Valve 51 may be operated to a second position in which it presents a check valve 51*a* blocking flow from its inlet to its outlet.

The electric control circuit for the ironer includes a manually operated "raise" switch which the machine operator can close to operate valves 48 and 51. Also, valve 50 is under the control of a sensing switch in the ironer which closes in response to the insertion of laundry flatwork into the ironer.

OPERATION OF LIFT CYLINDERS

After starting the pump motor, while the system is in the low pressure standby mode, as described, valves 48, 50 and 51 are in the positions shown in FIG. 2.

To raise the pistons in the lift cylinders 42*a*, 42*b*, 43*a*, 43*b*, 44*a*, 44*b*, 45*a* and 45*b*, the "raise" switch is closed so as to operate valves 48 and 51 to their second positions, in which valve 48 passes pressurized oil from passageway 40 to the inlet of valve 49 and the check valve 51*a* in valve 51 blocks the outlet 49*b* of valve 49 from the low pressure oil return passageway 41. The pump pressure is applied to the lift cylinders through valve 49 and the respective pressure reducing valves 62, 63, 64 and 65, which reduce the cylinder pressure to a preset value less than the pump pressure. This condition prevails for a predetermined time interval, such as 22 seconds, long enough to raise the steam chest to its operating position in the ironer.

At the end of this interval the timer T operates valve 50 to its second position, in which it vents the bypass port 49*c* of valve 49 to the low pressure return passageway 41. This reduces the oil pressure at the outlet port 49*b* to about 110 psi, which reduces energy consumption in the system.

Whenever a towel, sheet or other laundry flatwork is fed into the ironer, the flatwork-sensing switch in the ironer returns valve 50 to the position shown schematically in FIG. 2 so as to increase the pressure in the lift cylinders while the workpiece is being ironed.

When the ironing operation is completed and the drive motor for pump P is turned off, and valves 48, 50 and 51 are returned to the unoperated positions shown schematically in FIG. 2, the steam chest returns slowly to its lowered, inoperative position. The oil in the cylinders 42*a*, 42*b*, 43*a*, 43*b*, 44*a*, 44*b*, 45*a* and 45*b* flows slowly through the flow restrictions 72*a*, 72*b*, 73*a*, 73*b*, 74*a*, 74*b*, 75*a* and 75*b* and through check valves 82, 83, 84 and 85 to the inlet side of valve 51 and through this valve to the oil return lines 41 and 34.

From the foregoing description and the accompanying drawings it will be understood that the part of the present system shown in FIG. 1 provides a practical, effective and flexible hydraulic control over the operation of rollers in a laundry flatwork ironer, enabling (1) low pressure standby operation of pump P when the rollers are not being driven, (2) low speed operation of the hydraulic motor M from the pump for the "jog" drive to the rollers, and (3) higher speed operation of the rollers at a speed determined by the variable orifice 17. The part of the system shown in FIG. 2 enables the same pump to power cylinder-and-piston units for raising the steam chest up to the rollers in the ironer and for automatically reducing the fluid pressure in the cylinder except when laundry flatwork is going through the ironer.

We claim:

1. In a drive system for a laundry flatwork ironer having a plurality of rollers for ironing the flatwork and advancing it through the ironer, the combination of:
   - a hydraulic motor for driving the rollers;
   - a pump for supplying pressurized fluid to the motor to drive the motor;
   - means providing a low pressure passageway for fluid discharged by said hydraulic motor;
   - motor supply and return valve means operatively connect to said motor to control the flow of fluid from said pump to said motor and from said motor to said return passageway;

and selectively operable control valve means operatively connected hydraulically to cause said motor supply and return valve means either (a) to block fluid flow to and from said hydraulic motor or (b) to establish fluid flow from said pump to said motor and from said motor to said return passageway;

said selectively operable control valve means comprising:

a valve operatively connected hydraulically to said motor supply and return valve means to control the opening and closing of the latter;

and a pump pressure control valve operatively connected hydraulically to said pump for establishing either (a) a low output pressure of the pump for operating the hydraulic motor at low speed or (b) a higher output pressure of the pump for operating the hydraulic motor at higher speed.

2. In a drive system for a laundry flatwork ironer having a plurality of rollers for ironing the flatwork and advancing it through the ironer, the combination of:

a hydraulic motor for driving the rollers;

a pump for supplying pressurized fluid to the motor to drive the motor, said pump having an inlet port, an outlet port and a pressure sensing port, said pump being operable to maintain a predetermined pressure differential between its outlet port and its pressure sensing port;

means providing a low pressure return passageway for fluid discharged by said hydraulic motor;

valve means operatively connected to control the flow of fluid from said pump to said hydraulic motor and from said motor to said low pressure return passageway;

and a pump pressure control valve operatively connected to said pressure sensing port of the pump for controlling the output pressure of the pump, said pump pressure control having a first position in which it connects said pressure sensing port to said low pressure passageway for establishing a low output pressure from the pump and a second position in which it connects said pressure sensing port to said hydraulic motor for establishing a higher output pressure from the pump.

3. A system according to claim 2, wherein said valve means comprises:

a motor supply valve having an inlet port operatively connected to the pump output, an outlet port operatively connected to one side of the hydraulic motor, a sensing port, and means for (a) preventing fluid flow from its inlet port to its outlet port when the fluid pressure at its sensing port is substantially equal to or greater than the fluid pressure at its inlet port and (b) for establishing fluid flow from its inlet port to its outlet port when the fluid pressure at its sensing port is substantially less than the fluid pressure at its inlet port;

a control valve selectively operable to connect said sensing port of the motor supply valve to the pump output or to said low pressure return passageway;

and a motor return valve having an inlet port operatively connected to the opposite side of said hydraulic motor, an outlet port operatively connected to said low pressure return passageway, a sensing port, and means for (a) preventing fluid flow from its inlet port to its outlet port when the fluid pressure at its sensing port is substantially equal to or greater than the pressure at its inlet port and (b) for establishing fluid flow from its inlet port to its outlet port when the fluid pressure at its sensing port is substantially less than the fluid pressure at its inlet port;

and wherein:

said pump pressure control valve in its second position connects said pressure sensing port of the pump to said one side of the hydraulic motor;

and said control valve is selectively operable to (a) connect said sensing port of said motor return valve to the pump output when it connects the sensing port of said motor supply valve to the pump output and (b) to connect said sensing port of said motor return valve to said low pressure return passageway when it connects the sensing port of said motor supply valve to said return passageway.

4. A system according to claim 3 and further comprising:

a second motor supply valve having an inlet port operatively connected to the pump output, an outlet port operatively connected to said opposite side of the hydraulic motor, a sensing port, and means for (a) preventing fluid flow from its inlet port to its outlet port when the fluid pressure at its sensing port is substantially equal to or greater than the fluid pressure at its inlet port and (b) for establishing fluid flow from its inlet port to its outlet port when the fluid pressure at its sensing port is substantially less than the fluid pressure at its inlet port;

a second control valve selectively operable to connect said sensing port of said second motor supply valve to the pump output or to said low pressure return passageway;

and a second motor return valve having an inlet port operatively connected to said one side of said hydraulic motor, an outlet port operatively connected to said low pressure return passageway, a sensing port, and means for (a) preventing fluid flow from its inlet port to its outlet port when the fluid pressure at its sensing port is substantially equal to or greater than the pressure at its inlet port and (b) for establishing fluid flow from its inlet port to its outlet port when the fluid pressure at its sensing port is substantially less than the fluid pressure at its inlet port;

and wherein said second control valve is selectively operable to (a) connect said sensing port of said second motor return valve to the pump output when it connects the sensing port of said second motor supply valve to the pump output and (b) to connect said sensing port of said second motor return valve to said low pressure return passageway when it connects the sensing port of said second motor supply valve to said return passageway.

5. A laundry flatwork ironer having a plurality of horizontal rollers and a steam chest below the rollers which is vertically adjustable toward and away from the rollers in combination with a drive system which includes:

hydraulic cylinder-and-piston means for raising and lowering the steam chest;

a pump for supplying pressurized fluid to said cylinder-and-piston means to operate the latter;

and valve means operable to connect the output of said pump to said cylinder-and-piston means to operate the latter at a predetermined fluid pressure for raising said steam chest and to reduce the fluid pressure in said cylinder-and-piston means after it has raised the steam chest.

6. A drive system according to claim 5, wherein said valve means is operable to increase the fluid pressure in said cylinder-and-piston means when laundry flatwork is in the ironer.

7. In a drive system for a laundry flatwork ironer having a plurality of horizontal rollers and a steam chest below the rollers which is vertically adjustable toward and away from the rollers, the combination of:

hydraulic cylinder-and-piston means for raising and lowering the steam chest;

a pump for supplying pressurized fluid to said cylinder-and-piston means to operate the latter;

valve means operable to connect the output of said pump to said cylinder-and-piston means to operate the latter at a predetermined fluid pressure for raising said steam chest and to reduce the fluid pressure in said cylinder-and-piston means after it has raised the steam chest;

and a timer operatively coupled to said valve means to reduce the fluid pressure in said cylinder-and-piston means at a predetermined time after it has begun raising the steam chest.

8. A drive system according to claim 7, wherein said valve means is operable to increase the fluid pressure in said cylinder-and-piston means when laundry flatwork is in the ironer.

9. In a drive system for a laundry flatowrk ironer having a plurality of horizontal rollers for ironing the flatwork and advancing it through the ironer and a steam chest below the rollers which is vertically adjustable toward and away from the rollers, the combination of:

a hydraulic motor for driving the rollers;

hydraulic cylinder-and-piston means for raising and lowering the steam chest;

a pump for supplying pressurized fluid to both said motor and said cylinder-and-piston means;

valve means operatively connected to control the flow of fluid from said pump to said motor;

and valve means operatively connected to control the supply of pressurized fluid from said pump to said cylinder-and-piston means and comprising:

a motor supply valve operatively connected to said motor to control the flow of fluid from said pump to said motor;

and selectively operable control valve means operatively connected hydraulically to cause said motor supply valve either (a) to block fluid flow from said pump to said motor or (b) to establish fluid flow from said pump to said motor.

10. A system according to claim 9, wherein said selectively operable control valve means comprises:

a valve operatively connected hydraulically to said motor supply valve to control the opening and closing of the latter;

and a pump pressure control valve operatively connected hydraulically to said pump for establishing either (a) a low output pressure of the pump for operating the hydraulic motor at low speed or (b) a higher output pressure of the pump for operating the hydraulic motor at higher speed.

* * * * *